United States Patent [19]

Meyer et al.

[11] 4,101,748

[45] Jul. 18, 1978

[54] MODULAR PUFFER-TYPE CIRCUIT-INTERRUPTER UNIT ADAPTABLE FOR DIFFERENT VOLTAGE AND CURRENT RATINGS

[75] Inventors: Jeffry R. Meyer, Penn Hills Township, Allegheny County; Robert L. Hess, North Versailles, both of Pa.

[73] Assignee: Westinghouse Electric Corp., Pittsburgh, Pa.

[21] Appl. No.: 685,466

[22] Filed: May 12, 1976

[51] Int. Cl.[2] ..... H01H 33/82; H01H 9/30

[52] U.S. Cl. ..... 200/148 A; 200/144 AP; 200/82 B

[58] Field of Search ..... 200/286, 287, 289, 148 A, 200/148 R, 148 B, 82 B, 163, 144 AP, 150 G; 361/333, 335

[56] References Cited

U.S. PATENT DOCUMENTS

| | | | |
|---|---|---|---|
| 2,924,690 | 2/1960 | Browne | 200/148 A |
| 3,309,482 | 3/1967 | Leeds | 200/148 R |
| 3,358,105 | 12/1967 | Barker | 200/148 R |
| 3,446,928 | 5/1969 | Harper | 200/144 AP |
| 3,839,613 | 10/1974 | Tsubaki | 200/148 A |
| 3,941,962 | 3/1976 | Thaler | 200/148 A |
| 4,000,387 | 12/1976 | Millianowicz | 200/148 A |

*Primary Examiner*—B. Dobeck
*Assistant Examiner*—William L. Feeney
*Attorney, Agent, or Firm*—W. R. Crout

[57] ABSTRACT

An improved modular, puffer-type circuit-interrupting unit is provided capable of its own independent support, and adaptable for use, either as a singular modular unit, or when used with a plurality of similar units, constituting a conjointly-acting group of serially related puffer-units suitable for the higher-voltage applications.

The modular puffer-unit of the instant invention is capable of independent support, and is adaptable for very simple straight-line actuating movement, for not only causing contact separation, but also a simultaneous compression of the utilized gas to a pressurized state for gas ejection into the established arc for rapid arc extinction thereof. A novel feature of the instant invention is the utilization of a side insulating support baffle plate, which not only provides the desirable independent support for the stationary contact structure of the modular puffer-unit, but, additionally, serves as a baffle plate to prevent the lateral dispersion of the emanated hot arc gases from reaching the side tank wall, and thereby causing voltage flash-over.

6 Claims, 8 Drawing Figures

MODULAR PUFFER-TYPE CIRCUIT-INTERRUPTER UNIT ADAPTABLE FOR DIFFERENT VOLTAGE AND CURRENT RATINGS

CROSS-REFERENCES TO RELATED APPLICATIONS

Reference may be made to United States patent application filed Dec. 31, 1975, Ser. No. 645,753, by T. E. Alverson et al, entitled "Circuit Breaker"now abandoned, and United States patent application filed Dec. 31, 1975, Ser. No. 645,867, by Russell N. Yeckley et al, entitled "Circuit Breaker", United States patent No. 3,987,262, issued Oct. 19, 1976 to Joseph R. Rostron. Other applications, which may be referred to, are U.S. patent application filed May 12, 1975, Ser. No. 576,820, now U.S. Pat. No. 3,987,262, issued Oct. 19, 1976 to Joseph Rostron; U.S. patent application filed Aug. 7, 1975, Ser. No. 602,705, now U.S. Pat. No. 4,042,211, issued Aug. 23, 1977 to Cromer et al; U.S. patent application filed Sept. 25, 1975, Ser. No. 616,703, by Rostron et al; U.S. patent application filed Mar. 11, 1976, Ser. No. 665,823 by Charles F. Cromer et al; and U.S. patent application filed Sept. 21, 1976, Ser. No. 725,313 by Charles F. Cromer et al. Cromer et al, all of said patent applications being assigned to the assignee of the instant patent application. Reference may also be made to United States patent application filed Dec. 31, 1975, Ser. No. 645,752 by Cromer et al, entitled "Improved Double-Flow Puffer-Type Single-Pressure Compressed-Gas Circuit-Interrupter".

Reference should also be made to a closely-related United States patent application filed Mar. 21, 1975, Ser. No. 560,461 now U.S. Pat. No. 4,075,447, issued Feb. 21, 1978 to Joseph R. Rostron, entitled, "Double-Puffer-Type Compressed-Gas Circuit-Interrupter Constructions", and assigned to the assignee of the instant application. This patent application relates, in part, to two coacting serially related puffer structures simultaneously actuated by a single common operating rod, and disposed within a metallic tank structure. The stationary contact structure of each of the two puffer interrupters is supported by the lower interior end of a terminal-bushing supported by the tank structure. A bridging member electrically and mechanically interconnects the two conjointly-acting puffer structures, and is secured adjacent its center portion to a vertically-extending operating rod connected to the lower-disposed common mechanism.

BRIEF SUMMARY OF THE INVENTION

In accordance with the present invention, there is provided an improved, independently-mounted, modular puffer-type circuit-interrupting unit capable of wide application as a single unit, or, where desired, capable of ready application with a plurality of like similar modular units, all adaptable for simultaneous series operation with a single common operating mechanism.

A simplified baffle-plate construction is provided to independently support the stationary contact structure of each modular unit, thereby permitting the independent assembly of a number of modular puffer-units, and a subsequent incorporation of one or more of the modular units into electrical equipment in single, or series application, depending upon the voltage requirements. The aforesaid insulating support baffle plate, additionally, serves the purpose of preventing lateral dispersion of the hot arc gases from the arc striking the metallic side tank wall, and thereby preventing voltage flashover between the interiorly-disposed contact parts, which, of course, are at high voltage, and the side metallic tank wall which obviously is at ground potential.

The movable operating-cylinder construction, taken in conjunction with the relatively-stationary piston structure, is such as to permit a desirable straight-line actuating motion, thereby requiring only a single pull-rod for each modular puffer-unit. This has the further advantage that the modular puffer-units may be stacked in series, or arranged in pairs, for the higher-voltage applications, and yet the plurality of pull-rods for the several units may readily be mechanically interconnected together for simultaneous operation by a single common operating mechanism.

Associated with the lower end of each modular puffer-unit is a mounting surface, such as, for example, a relatively-heavy metallic support plate, which not only supports the stationary piston structure, but, additionally, supports the upstanding insulating support baffle plate, the latter, as mentioned, supporting the upper-disposed relatively-stationary contact for the respective modular puffer-unit. The metallic support plate, additionally, serves as a convenient means for transferring current from the movable contact structure to the said support plate, and from the support plate to other modular units, when used, where a series modular application is encountered.

Where, however, a single modular puffer-unit is desired, the said support plate constitutes a desirable mounting surface, which may itself be supported in a fixed position by a suitable upstanding insulating pedestal, or hollow support cylinder, through the interior of which preferably movably extends the operating "pull", or operating rod for the respective unit.

DESCRIPTION OF THE PREFERRED EMBODIMENTS

Figure 1:
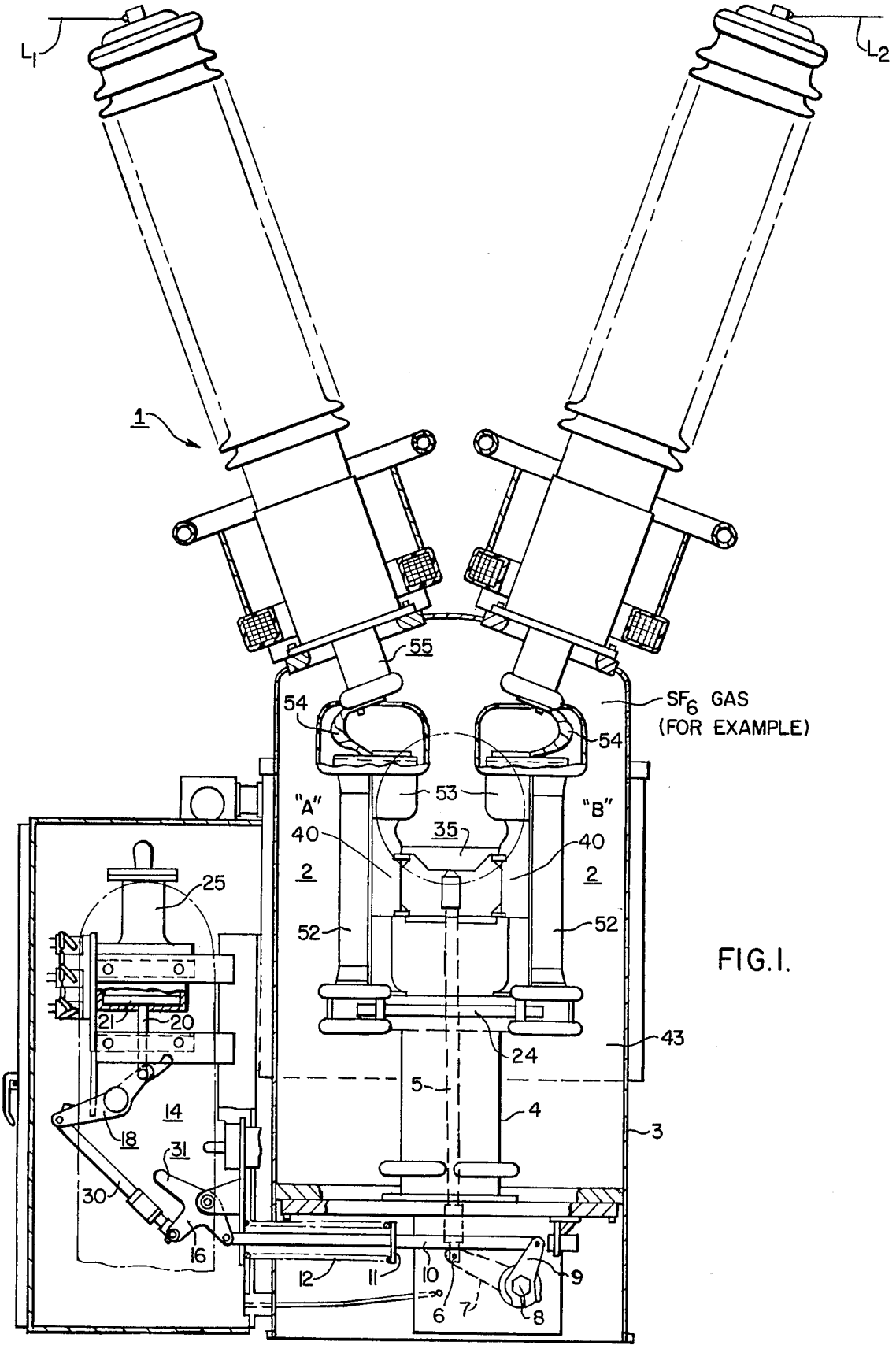
FIG. 1 is a vertical sectional view taken through a puffer-type compressed-gas circuit-interrupter assemblage incorporating two of the modular puffer-units of the instant invention disposed electrically in series, and adaptable for simultaneous operation, the contact structure being illustrated in the closed-circuit position.
Figure 2:
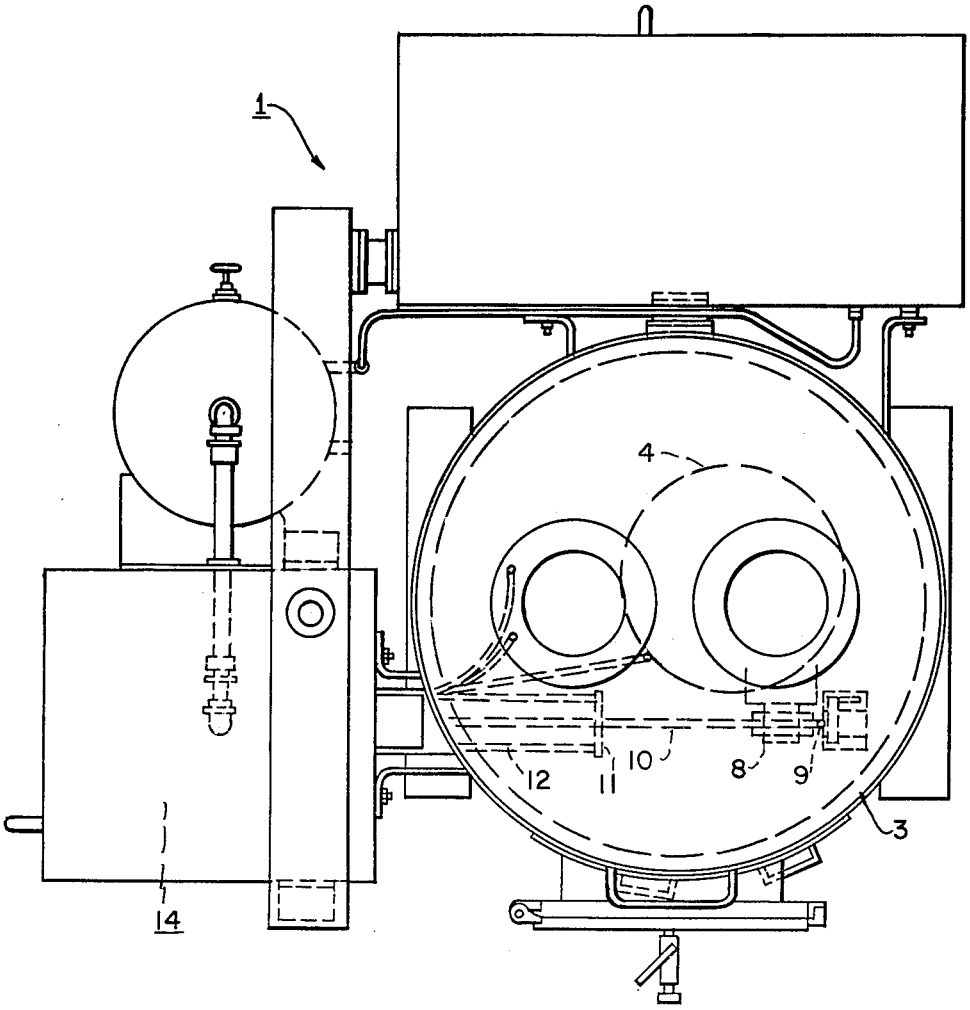
FIG. 2 is a top plan view of the outer tank assembly with the terminal-bushings removed for clarity.

Referring to the drawings, and more particularly, to FIGS. 1 and 2 thereof, it will be observed that FIG. 1 illustrates a tank-type compressed-gas circuit-interrupter 1 involving two modular puffer-units 2 disposed electrically in series, and adaptable for common actuation. As shown, the two modular units 2 are disposed interiorly within an outer tank 3, and supported upon a hollow insulating pedestal, or support cylinder 4, through which the common operating rod 5 for the two modular units 2 extends. The lower end of the operating rod 5 is pivotally connected, at 6, to a bell-crank lever assembly 7 having an operating shaft 8 and an operating arm 9, which is pivotally connected to a floating link 10 carrying a spring-plate 11 therewith. As shown in FIG. 1, the spring-plate 11 seats a compression spring 12, which tends to force the interrupter 1 to the closed-circuit position, as illustrated in FIG. 1.

A suitable actuating linkage 14 is provided to effect opening of the interrupter 1, which comprises a second bell-crank lever 16 carrying interconnecting linkage to a third bell-crank lever 18, the latter being rotated by a piston-rod 20 connected to a suitable piston 21 for pneumatic operation. Accordingly, to effect opening of the circuit-interrupter, the valve means 25 is actuated to permit high-pressure gas to act against one face of the actuating piston 21, which, in turn, moves downwardly to effect downward motion of the piston-rod 20 and consequent clockwise rotation of the third bell-crank lever system 18. The clockwise rotation of the third bell-crank lever system 18, in turn, through the floating link 30, effects corresponding clockwise rotation of the second bell-crank lever system 31, thereby causing leftward opening motion of the floating link 10, causing thereby the compression of the compression spring 12 and consequent downward opening motion of the pull-rod 5.

Figure 3:
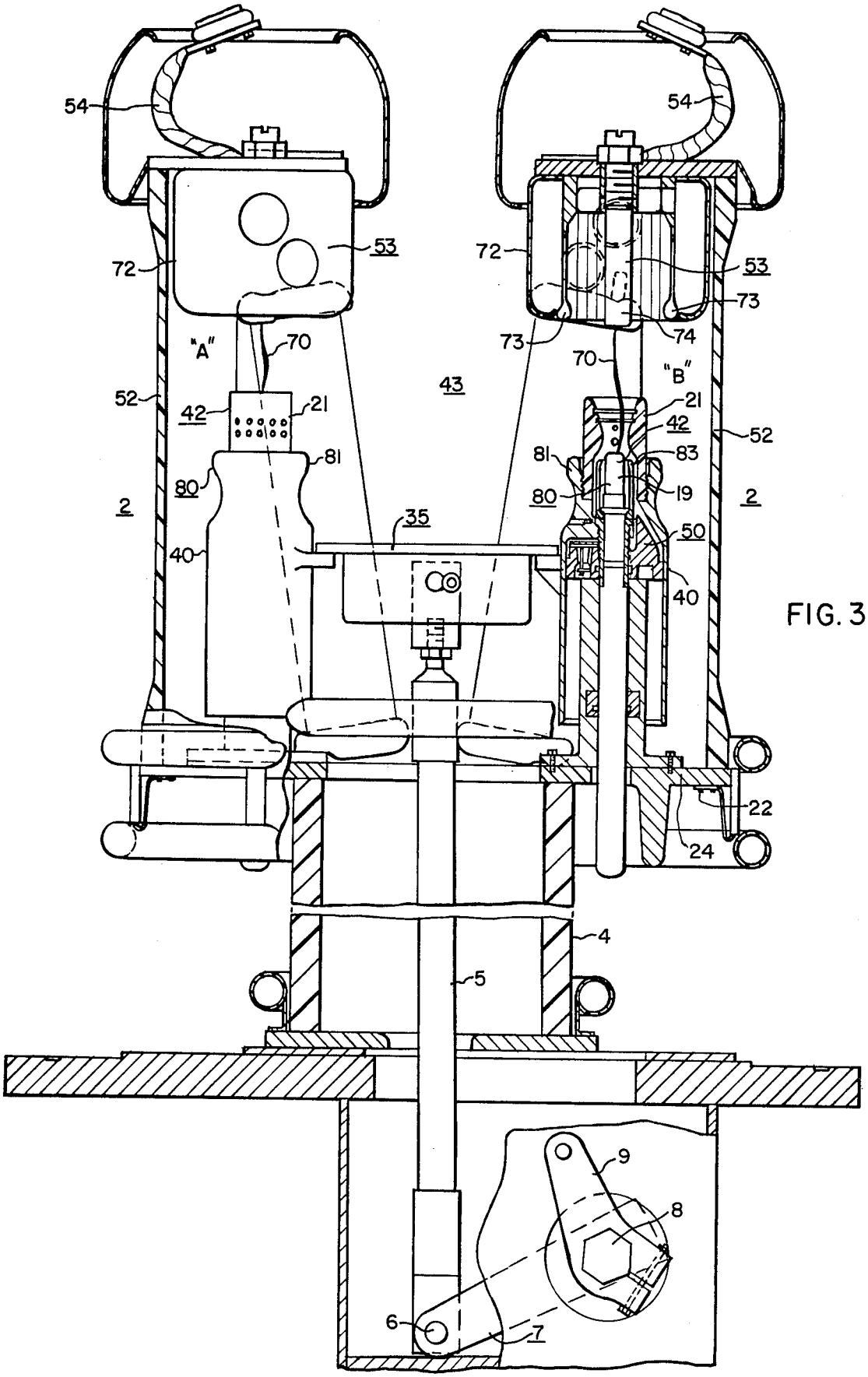
FIG. 3 is an enlarged view of the interiorly-disposed arc-extinguishing assemblage of the equipment illustrated in FIG. 1, the view showing one modular puffer-unit in side elevation, with the companion puffer-unit in vertical section, in this instance the contact structure of both units being illustrated in the fully-open-circuit position.

As illustrated more clearly in FIG. 3, the pull-rod 5 is connected at its upper end to the movable cross-bar member 35, which is fixedly bolted to the two operating cylinders 40, and thereby causes their simultaneous downward opening motion. Such motion, of course, is translated into simultaneous separation motion of the contact structure 42 and compression of the gas 43 between the operating cylinder 40 and the relatively-stationary piston structure 50 associated with each of the two series modular puffer-units 2.

Figure 6:
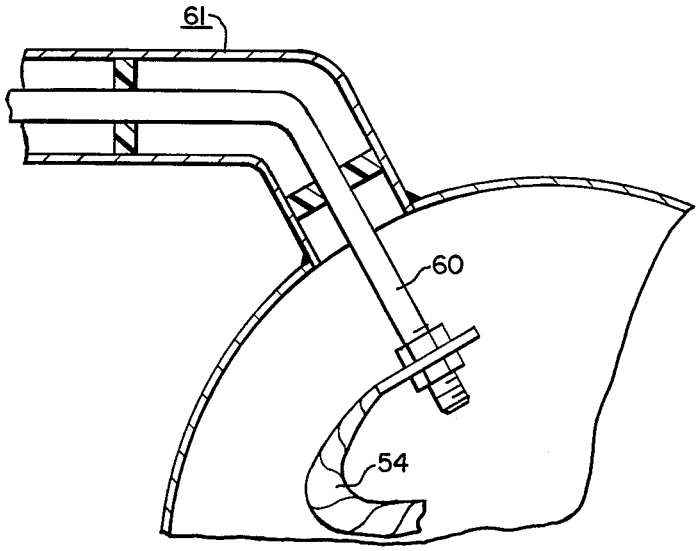
FIG. 6 illustrates an alternate transmission line connection to the stationary contact structure of the two modular units of FIG. 1 being connected to an associated gas-insulated transmission line arrangement.

It will be observed that each modular unit 2 is capable of independent support by the utilization of a side insulating baffle plate 52, which supports the upper stationary contact structure 53. As a result, no additional support of the stationary contact structure 53 is required, and it may be merely electrically connected by a flexible lead-terminal connection 54 to either a terminal-bushing 55, as illustrated in FIG. 1, or, where required, to the line conductor 60 in gas-insulated transmission equipment 61, as somewhat diagrammatically illustrated in FIG. 6.

With reference to FIG. 3 of the drawings, it will be noted that the side baffle support plate 52 (which supports the stationary contact 53) is itself upstandingly supported by bolts 22 to a heavy horizontal support plate 24, which preferably, although not necessarily, may be of casting form.

Again, with reference to FIG. 3, it will be observed that upward movement of the operating rod 5 effects closing of the modular puffer-units 2, and downward movement thereof effects separation of the two-break interrupting structure 1 and a consequent interruption of the two arcs 70, which are drawn in series, and illustrated somewhat diagrammatically in FIG. 3 of the drawings.

Figure 5:
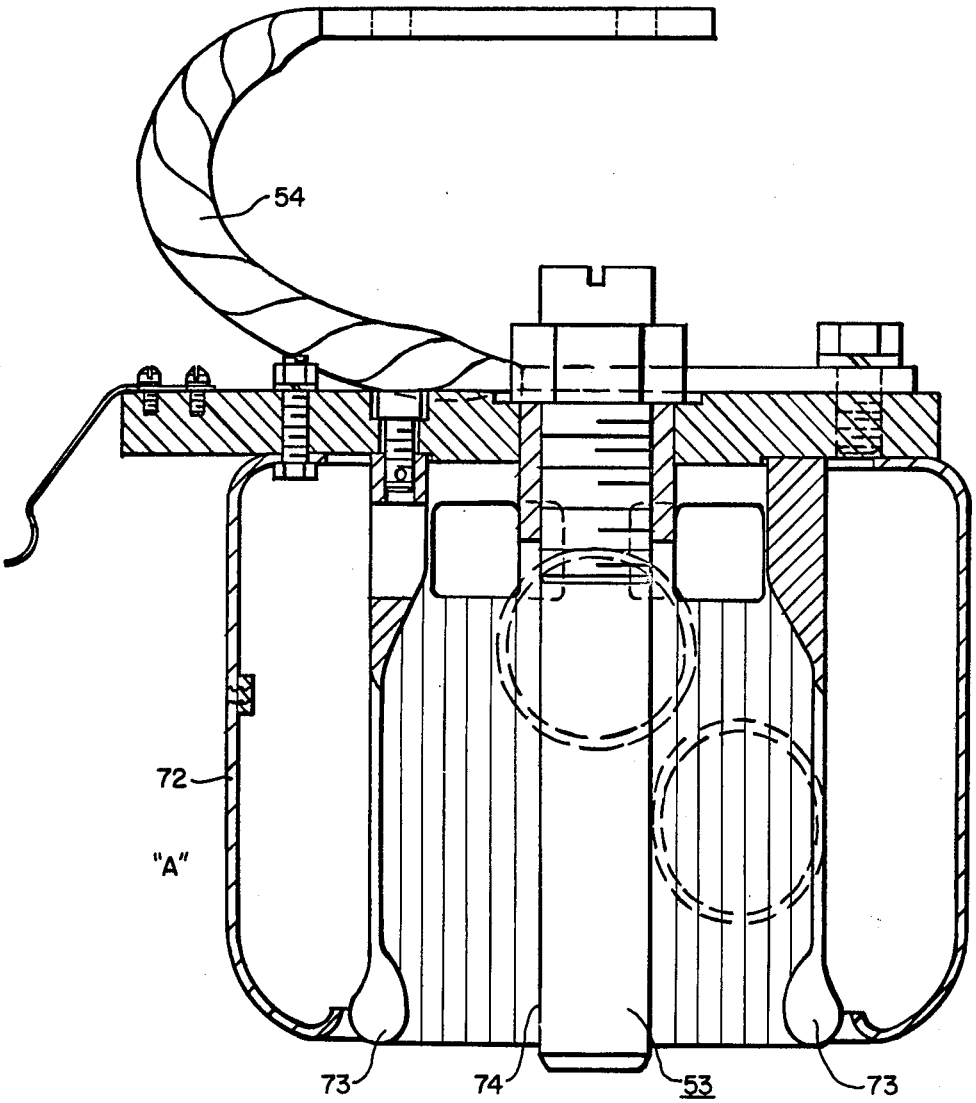
FIG. 5 is an enlarged view of the stationary contact structure for each of the individual modular units of FIG. 3.

With reference to FIG. 5, it will be observed that the stationary contact structure 53 includes a metallic voltage shield 72, an interiorly-disposed cluster of relatively-heavy main stationary contact fingers 73, and a centrally-disposed tubular stationary arcing contact 74.

Figure 4:
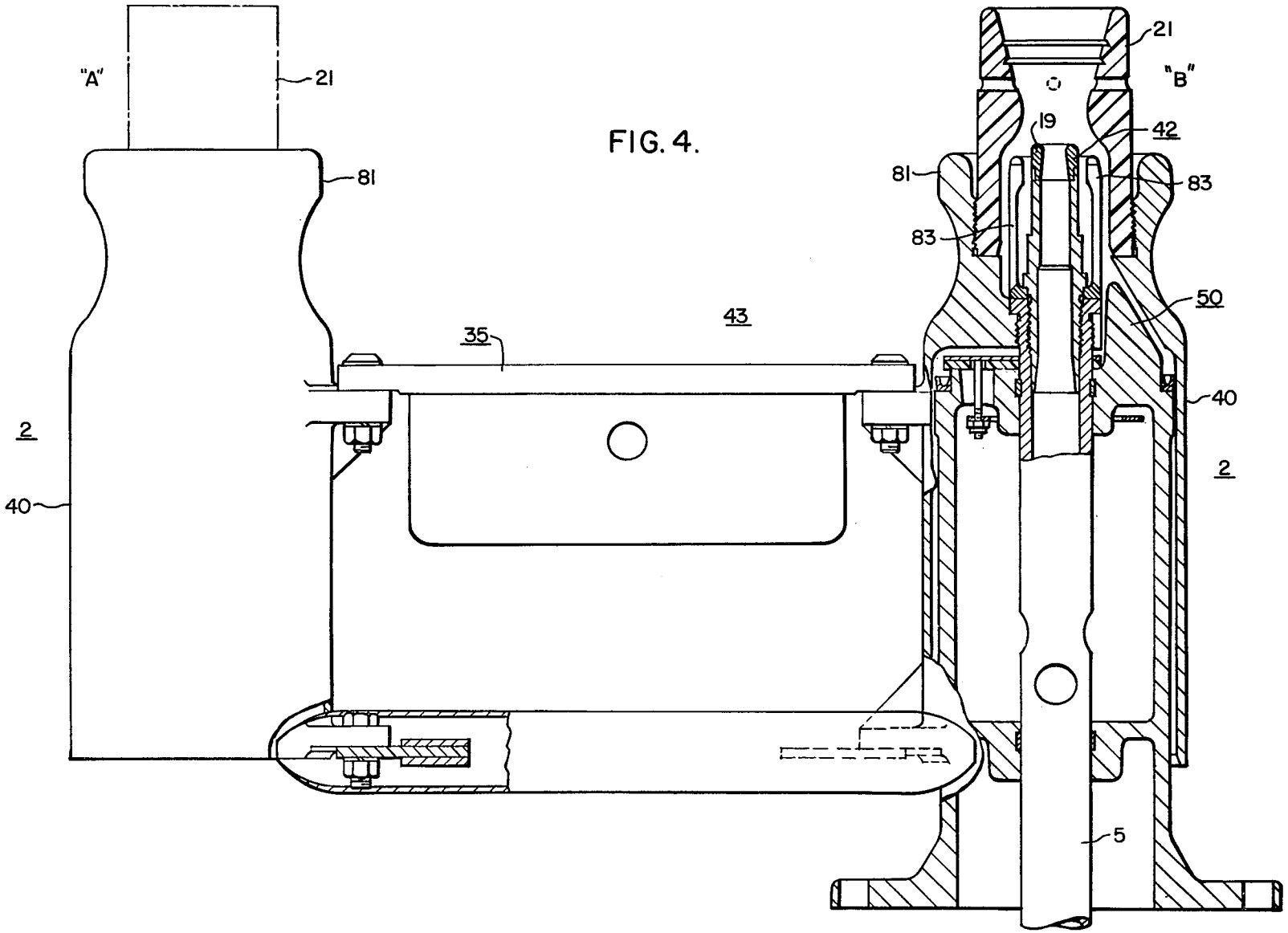
FIG. 4 is an enlarged side-elevational view, partially in vertical section, of the movable contacts only of a pair of serially-related arc-extinguishing units, the contact structures being illustrated in the fully-open-circuit position.

The movable contact structure 80 comprises an outer annular main movable contact surface 81, which makes contacting engagement in the closed-circuit position of the interrupter with the relatively-heavy main stationary contact fingers 73. Additionally, secondary movable contact fingers 83 (FIG. 4) make contacting engagement with the external side surface of the tubular stationary arcing contact 74, with a central movable arcing contact 19 (FIG. 4) protruding, or extending into the tubular stationary arcing contact 74. Accordingly, during the opening operation, initial contact separation occurs between the relatively-heavy main stationary contact fingers 73 and the movable annular main contact 81. At a subsequent point in time, contact separation occurs between the secondary movable arcing contact fingers 83 and the outer surface of the centrally disposed tubular stationary arcing contact 74. Finally, contact separation occurs between the stationary and movable arcing contacts 19, 74, drawing an arc 70, as shown diagrammaticallyin FIG. 3, which is, of course, blasted by an upwardly-flowing compressed-gas flow passing through the movable insulating hollow orifice member 21.

Arc extinction soon follows, and continued opening downward movement creates an isolating-gap condition, as illustrated in FIG. 3 of the drawings.

The metallic voltage-shield construction 72 is set forth and claimed in U.S. patent application filed May 12, 1976 Ser. No. 685,465 by Jeffrey R. Meyer et. al., and assigned to the assignee of the instant patent application.

It will be noted that the side insulating baffle support 52 individually supports the stationary contact structure 53 for the individual modular puffer-units 2. In addition, the electrical current is transferred between the two modular units 2 by the metallic conducting cross-bar, or bridging member 35. Thus, the interrupter 1 provides two series breaks "A", "B", as designated in FIG. 1, adaptable for a voltage rating, for example, of 242 kV, with an interrupting capability, for example, of 50 K.A., or 63 K.A. with slight modifications.

Figure 7:
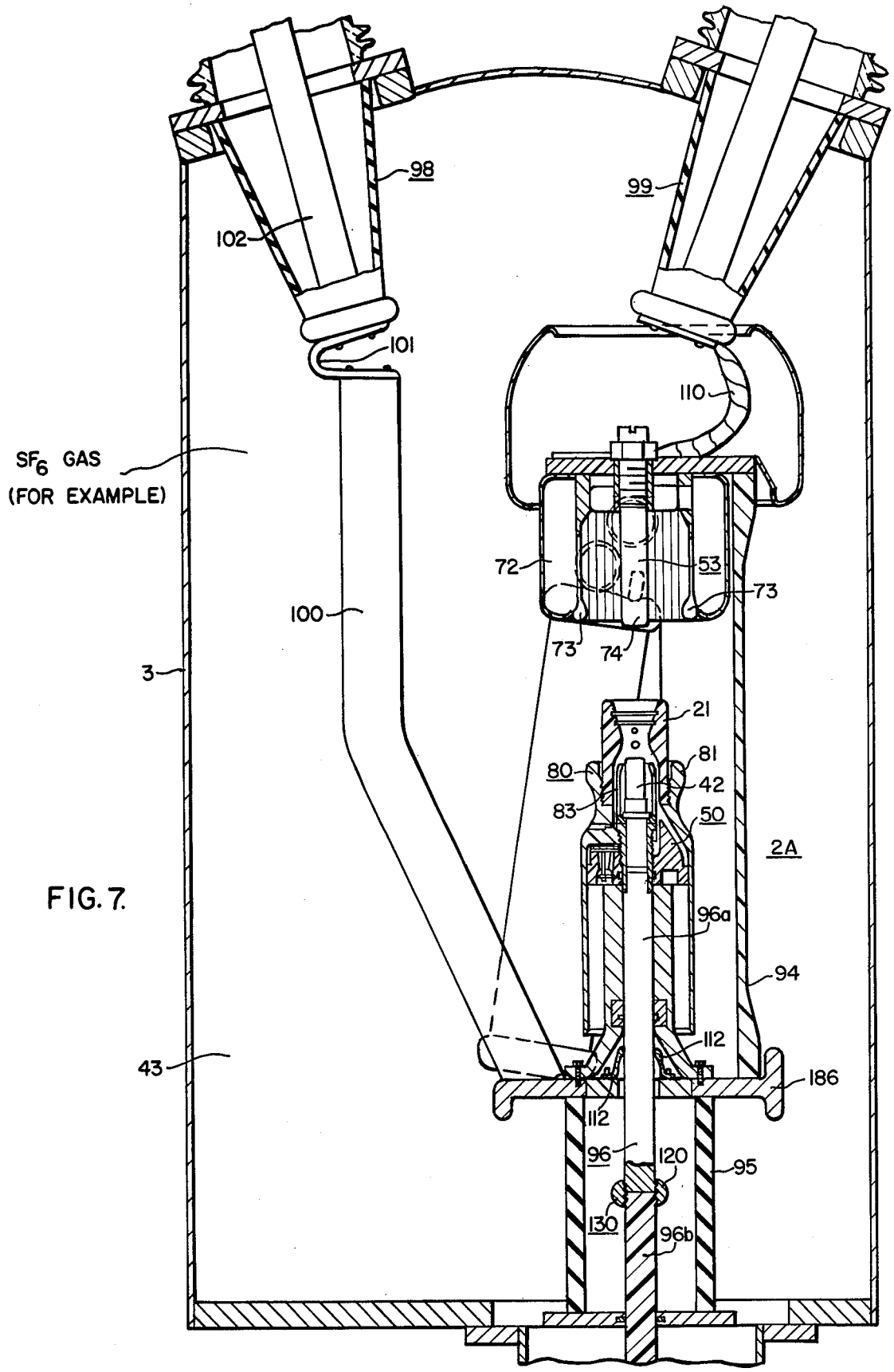
FIG. 7 illustrates the application of a singular modular puffer-unit alone supported within an individual metallic grounded tank, and adaptable for terminal-bushing connections, the single unit illustrating the contact structure in the fully-open-circuit position; and, FIG. 8 illustrates a modification of the invention in which four modular puffer-interrupting units are utilized in series for a higher-voltage application, say, for example, 550 KV, the contact structure being illustrated in the open-circuit position.

In view of the fact that each modular unit 2 is capable of independent support by the baffle 52, for the lower-voltage ratings, as illustrated in FIG. 7, merely a single unit 2A may be utilized, as shown. Thus, as illustrated in FIG. 7, the mounting surface, or relatively-heavy metallic support plate 186 may be supported upstandingly by the hollow insulating support pedestal 95 having the operating rod 96 extending therethrough. The tank size in this embodiment of the invention, as shown in FIG. 7, may be considerably reduced, two terminal-bushings 98, 99 being employed with a relatively-heavy bus-bar connection 100 leading, through a U-shaped flexible strap 101, to the lower terminal stud 102 of the left-hand terminal-bushing 98. The right-hand terminal-bushing 99 may be electrically connected by the flexible conductor 110 in the same manner as illustrated in FIG. 1.

The manner of current transfer from the movable contact structure of the modular puffer-unit 2A to the stationary support plate 186 may be advantageously achieved by the use of stationary contact fingers 112, as shown. The pull-rod 96 itself may be composite, having the upper portion **96*a* thereof being of conducting material, whereas the lower portion 96*b* may be of insulation in order to withstand the impressed line voltage. The transitional point therebetween of portions 96*a*, 96*b* may be of the simple threaded socket connection type 130 with a metallic shield-ring 120** employed for the gradation of voltage.

Any suitable operating mechanism may, of course, be used in the construction of FIG. 7, either pneumatic, hydraulic or of the solenoid type. Obviously, the same type of operating mechanism 14 may be used in FIG. 7 as was described heretofore in connection with the two-break device 1, set forth in FIGS. 1 and 3.

Figure 8:
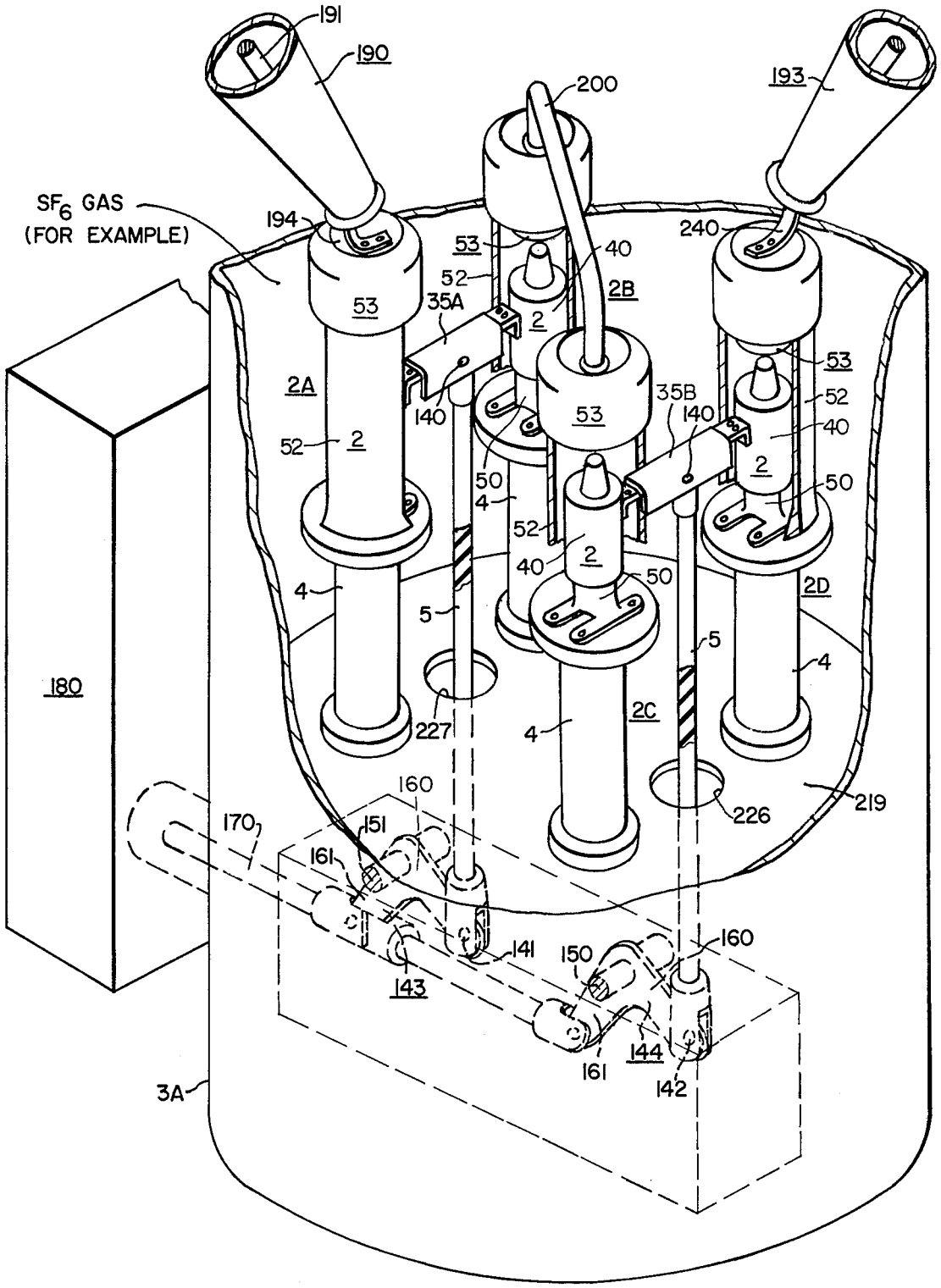

With reference being directed now to FIG. 8 of the drawings, wherein a modification of the invention utilizes four modular puffer-type compressed-gas circuit-interrupter units 2 disposed in electrical series, for the higher-voltage applications, say, for example, 550 KV, it will be observed that again there is provided a surrounding grounded metallic tank designated by the reference numeral 3A: Disposed within the tank modified-type 3A are the four modular puffer-units 2, each of which is supported in an upstanding condition by its own individual insulating hollow supporting pedestal 4.

As shown in FIG. 8, the units 2 are actuated in pairs, each pair of units having a metallic conducting bridging member 35A, not only electrically connecting it to its conjointly-acting unit, but, additionally, providing a pivotal point 140 for the interconnection with the insulating operating rod 5, each operating rod 5 being pivotally connected, as at 141, 142 to a lower-disposed bell-crank lever system 143, 144. As shown, there are two bell-crank lever systems 143, 144, each comprising a generally horizontally-extending stationary rotatable main operating shaft 150, 151, a pair of angularly-extending arms 160 and 161, one of which is pivotally connected to the vertically-movable insulating operating rod 5, and the other arm being pivotally connected to a main horizontally extending linearly-movable drive-rod 170. As shown, the drive-rod 170 extends at its left-hand end into a mechanism housing 180, wherein any suitable drive mechanism may be employed, either pneumatic, solenoid or hydraulic. If desired, of course, a pneumatic driving operating mechanism of the type illustrated in FIGS. 1 and 2 may be employed, the rod 10 of FIG. 1 being equivalent to the horizontally extending driving-rod 170 of FIG. 8.

As will be obvious, a pair of terminal-bushings 190, 193 extend into the tank 3A of FIG. 8, which, of course, is of a single-phase construction type involving the four modular units 2A-2D disposed electrically in series. The terminal-bushing 190 has its stud portion 191 connected by a flexible connector 194, for example, to the upper stationary contact structure 53 of modular unit "2A". From the upper end of modular unit "2B" extends a generally inverted U-shaped bus bar 200 electrically interconnecting the two relatively-stationary contact structures 53 of the two modular units "2B" and "2C". The puffer unit "2C" is, as shown, electrically connected by the movable bridging member 35B to the movable contact structure 53 of its conjointly-acting modular puffer-unit "2D". The stationary contact structure 53 of modular unit "2D" is, as shown, electrically connected by a flexible strap connector 240 to the other companion terminal-bushing 193. The upper dome cover of the modified tank structure 3A has not been illustrated, and has, as shown in FIG. 8, been broken away for clarity.

FIG. 8 also shows a relatively-heavy horizontally-extending main support plate 219 secured, as by welding, for example, to the inner sidewalls of the modified tank structure 3A adjacent its mid-portion. The heavy stationary support plate 219 may be provided with a pair of openings 226, 227, through which the vertically-extending movable insulating operating rods 5 extend in their opening and closing motions.

From the foregoing description, it will be apparent that there has been provided an improved modular, self-sustaining puffer-interrupting unit 2, capable of independent support, and adaptable for either singular or multiple use, as shown. The module 2 may be used individually for a 145 kV interrupter, as shown in FIG. 7, or several units 2 can be used in series up to any practical number, such as four, for example, for a 500 kV interrupter rating as shown in FIG. 8, or more, if desired, arranged, for example, in a manner as shown in FIG. 8. All that is needed for a single unit 2 is to provide a proper mounting surface, such as the support plate 186 of FIG. 7, and for multiple unit 2 suitable supports to mechanically connect the movable puffer-cylinders 40 together. For a 145 kV application, for instance, as shown in FIG. 7, a "Cupalloy" guide pull-rod 96 could be utilized, with transfer contacts 112 provided between the mounting surface 186 of FIG. 7 and the longitudinally-movable pull-rod 96 shown in the same figure.

Although there has been illustrated and described specific structures, it is to be clearly understood that the same were merely for the purpose of illustration, and that changes and modifications may readily be made therein by those skilled in the art, without departing from the spirit and scope of the invention.

We claim:

1. A gas-blast circuit-interrupter comprising, in combination, means defining a grounded metallic tank, a pair of terminal-bushings extending into said grounded metallic tank and carrying a pair of spaced interiorly-disposed line-terminal connections at the inner ends thereof, at least one modular-type puffer-interrupting unit disposed within said tank, a metallic supporting plate at high voltage (186) disposed within said grounded metallic tank for fixedly supporting said modular-type puffer-interrupting unit, insulating supporting means (95) for supporting said metallic support-plate (186) within said tank an adequate insulated distance from the inner walls of said grounded metallic tank, means defining a stationary contact structure (53) having a flexible line-connector (110), a side insulating bridging baffle-plate for solely fixedly supporting the stationary contact structure from said metallic supporting plate (186), means defining a fixed piston structure (50) supported from said metallic supporting plate (186), means defining a movable contact assemblage comprising an insulating hollow nozzle, a movable contact and a movable operating cylinder with the latter slidably moving over said relatively-fixed piston structure for the compression of gas therebetween, said movable contact being cooperable with said relatively-stationary contact structure (53) to establish an arc (70) through said insulating hollow nozzle (21), the gas compressed between the movable operating cylinder and the stationary piston structure passing through said hollow nozzle (21) adjacent the established arc (70) to effect the extinction thereof, operating-rod means for actuating the movable contact structure reciprocally operable through said metallic supporting plate (186) for effecting the opening and closing operations of said modular-type puffer-interrupting unit, means electrically connecting said flexible terminal-lead (110) with one of said two terminal-bushings, means electrically connecting the movable contact structure to the line-terminal connection of the other terminal-bushing, and said side insulating bridging baffle-plate not only serving as the sole supporting means for the relatively-stationary contact structure (53) but, additionally, preventing the lateral dispersion of the emanated hot arcing gases from reaching the inner side metallic tank wall which would tend to promote voltage flashover.

2. The combination according to claim 1, wherein the relatively-stationary contact structure comprises a cluster of annularly-arranged relatively-heavy stationary main contact fingers and a centrally-disposed stationary arcing contact.

3. The combination according to claim 2, wherein the movable contact structure comprises an annular movable main contact cooperable with the said stationary relatively-heavy main contact fingers and a centrally-disposed moving arcing contact.

4. The combination according to claim 3, wherein a cluster of annularly-arranged secondary movable contact fingers surround the movable arcing contact.

5. The combination in a metallic tank-type compressed-gas circuit-interrupter of a pair of serially-related modular puffer-type arc-extinguishing units, each modular unit comprising a relatively-stationary contact structure and separable movable contact structure, each modular unit including its own individual laterally-disposed side-insulating baffle-plate of generally semicircular configuration, said baffle-plate solely supporting the relatively-stationary contact structure a predetermined distance away from the movable contact structure, flexible connecting means for each relatively-stationary contact structure of the two modular units, means electrically connecting the two modular units together by a horizontal conducting bridging member, and pull-rod means connected to said bridging member for effecting simultaneous actuation of each modular unit.

6. The combination according to claim 5, wherein an annular main metallic supporting plate supports the two modular units in lateral spaced relationship, and a hollow insulating pedestal supports said relatively-heavy support plate the desired distance above ground potential.

* * * * *